United States Patent [19]

Caliri

[11] 4,038,634

[45] July 26, 1977

[54] AUTOMOBILE WARNING SYSTEM

[76] Inventor: Frank Caliri, 2 Royal Crest Drive, Marlboro, Mass. 01752

[21] Appl. No.: 710,722

[22] Filed: Aug. 2, 1976

Related U.S. Application Data

[63] Continuation of Ser. No. 544,242, Feb. 6, 1975, abandoned.

[51] Int. Cl.[2] ..... G08B 19/00

[52] U.S. Cl. ..... 340/52 F; 340/181; 340/415; 180/103 R

[58] Field of Search ..... 340/52 R, 52 B, 52 F, 340/57, 58, 60, 147 R, 181, 182, 251, 346, 415; 180/103

[56] References Cited

FOREIGN PATENT DOCUMENTS 175,311 2/1922 United Kingdom ..... 340/269

*Primary Examiner*—Alvin H. Waring

*Attorney, Agent, or Firm*—Norman S. Blodgett; Gerry A. Blodgett

[57] ABSTRACT

A warning system for installation in a vehicle, the system including a transducer located at a selected location in the vehicle to detect conditions existing at the location and to generate a signal containing raw information, a master unit connected to the transducer and an indicator connected to the master unit. The master unit includes means for removing extraneous information from the raw information in the signal generated by the transducer and thereby producing a remaining signal for use by the operator of the vehicle.

1 Claim, 6 Drawing Figures

AUTOMOBILE WARNING SYSTEM

This is a continuation of application Ser. No. 544,242, filed Feb. 6, 1975, now abandoned.

BACKGROUND OF THE INVENTION

Many of the catastrophic and non-catastrophic component failures that occur in motor vehicles are preceded by subtle warnings. These warnings often take the form of vibrations and noise over a wide spectrum of frequency. They can result in pinpoint anticipation of failure and efficient preventive maintenance of the vehicle, if detected by a person who is skillful enough to understand them. Many factors militate against this detection and proper interpretation by the operator, by skilled mechanics, or by modern mechanical and electronic diagnostic equipment. One factor is, of course, that many of the warning signals only occur when the vehicle is in operation and, morespecifically, under particular stress or other operating conditions. This situation makes it difficult to command occurence of the signal at the time when its detection and interpretation are easiest. Another factor is that modern car design includes the extensive use of sound damping and insulation to isolate the driving compartment from engine, drive-train, and wheel noise. Thus, even if the operator is skilled enough to discriminate between normal operating noise and warning signals and thereafter to interpret the warning signals, his opportunity to hear the noise at all is severely limited in modern automobiles. The last factor is that the modern operator is normally not a skilled mechanic and, even if he could hear the operating noise of the automobile, he would not have the ear to distinguish what is normal from what is not, nor the experience to interpret the abnormal signals. These and other difficulties experienced by prior art methods have been obviated in a novel manner by the present invention.

It is, therefore, an outstanding object of the invention to provide an automobile warning system which is sensitive to the vibration and noise warning system generated by the operating components of a vehicle and which indicates to the operator the presence and nature of these signals.

Another object of this invention is the provision of an automobile warning system which provides for the placement of remote sensors at various strategic locations about the vehicle.

A further object of the present invention is the provision of an automobile warning system, including a signal modification system which removes extraneous matter from the signal generated by the tranducers and modifies the remaining signal into a more useful form.

A still further object of the invention is the provision of an automobile warning system, including a display device which presents pertinent data from the sensors to the operator at his command.

It is a further object of the invention to provide an automobile warning system which presents the pre-failure warning signals in a form which can be understood by an operator with minimum interpretative skills.

It is a still further object of the present invention to provide an automobile warning system which is both simple and inexpensive to manufacture and operate.

Another object of the invention is the provision of an automobile warning system which is flexible enough to be used in a wide variety of vehicles, to be sensitive to a wide range of pre-failure warning signals, and to be capable of a wide range of modifications on the signals generated by the sensors.

With these and other objects in view, as will be apparent to those skilled in the art, the invention resides in the combination of parts set forth in the specification and covered by the claims appended hereto.

SUMMARY OF THE INVENTION

This invention involves an automobile warning system for installation in a vehicle, the system including a plurality of transducers located at various strategic locations about the vehicle, a master unit which accepts raw signals generated by the transducers, modifies the rough signals to remove extraneous information and produces a remaining signal, and an indicator for displaying the remaining signal taken from the master unit. More specifically, the transducer generates the signal which is indicative of vibration and noise occuring at the transducers location. The signal includes both a normal and an abnormal component. The master unit is capable of removing the normal component as extraneous information. The indicator thus displays the abnormal information as it occurs.

BRIEF DESCRIPTION OF THE DRAWINGS

The character of the invention, however, may be best understood by reference to one of its structural forms, as illustrated by the accompanying drawings, in which.

GENERAL DESCRIPTION OF THE INVENTION

Figure 1:
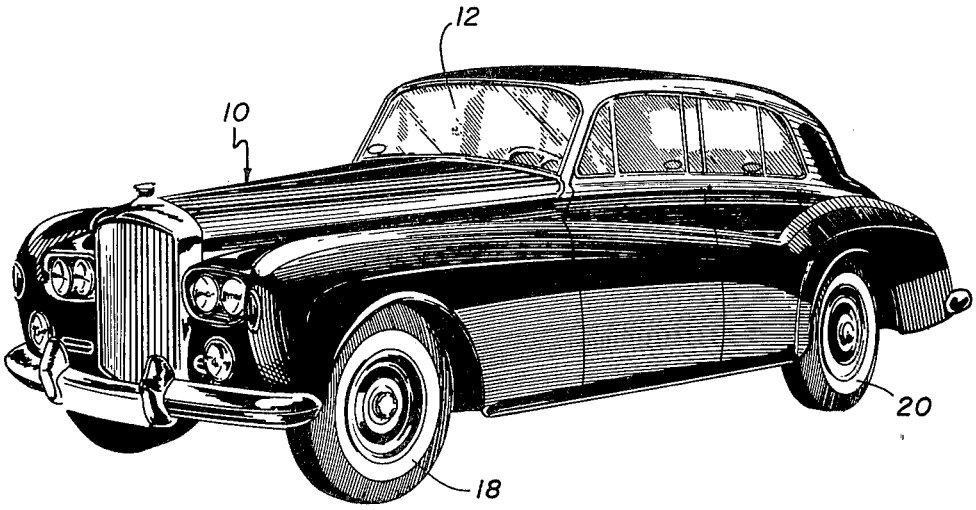
FIG. 1 is a perspective view of a vehicle containing an automobile warning system embodying the principles of the present invention.

This invention relates to electronic equipment used as a safety and warning device for detecting and locating fault conditions in motor vehicles. It is particularly useful to detect and warn the vehicle operator or user of faults in running gear that are discernable only when the vehicle is moving under load. For example, this invention is particularly adapted to (but not limited to) the detection of abnormal noises in vehicular running gear due to non-catastrophic fault conditions, such as defects in universal joints, suspension, and steering linkage and components, drive and axel shafts, wheel and differential bearings, ring and pinion gears, transmission and clutch components, brakes, tires, and other components.

The object of this invention is to amplify and warn the occupant of a vehicle of impending danger by detecting the presence of an abnormality in the operating condition of the vehicle before it would otherwise be ascertainable and before complete failure occured in any critical structure or component. Another important feature of this invention is its ability to locate specifically the sources of such defects by the proper placement of a plurality of detecting devices, thereby simplifying the task of vehicle maintainence and service. In this aspect this invention, when set up and used in this manner as a diagnostic device, creates significant cost savings to the user by eliminating needless replacement of acceptable components which are often needlessly replaced in error because of difficulty of the human ear to discriminate against the low frequency sounds which are normal to vehicle faults and the actual fault condition. It is also possible with variations of this invention to monitor and amplify vibrations in the mechanical members of the vehicle. Such vibrations occur in the frame, loose or broken bumper assemblies, defective shock absorbers, and other components, including broken motor mounts as well as non-critical, but annoying common rattles which very often defy detection. It is still another major feature of this invention to monitor the condition of the internal engine components of a motor vehicle for defects that become apparent only when the vehicle is subjected to heavy strain while down-shifting in emergencies or while passing other vehicles. It is yet another major feature of this invention that the use of the equipment requires a minimum of operators attention, so that this invenion may be utilized to its fullest capacity to monitor conditions of the vehicle while the vehicle is in normal use.

This invenion is an electronic system comprising: transducers placed in strategic locations within or on the vehicle; means for selecting particular signals from a selected transducer; means to amplify these signals; means to filter out undesirable sounds and signals; and means to present the desired information to the operator or other user. Many conditions produce suitable signals that may merely be reproduced, such as wheel bearing noise, bumps or breaks in a tire, worn or dragging brakes, defective universal joints, suspension and steering components, rattles caused by defective or loose critical and non-critical other components. This system can be permanently installed in a vehicle and adjusted to by-pass all normal operating noises or frequencies that are consistent with a normal functioning vehicle and becomes operative only when an abnormal noise or frequency is developed by usage, wear, accident or otherwise. As a diagnostic system, it can be constructed so as to be portable and to be easily installed for expedititious detection of fault condition. This system, therefore, although not limited to these applications, can be utilized either as a warning device of impending failure of a component to the non-technical vehicle operator or user or as a diagnostic aid to permit expeditious and economical determination of improper functioning of various critical and non-critical components. With vehicle design and manufacturing technology having developed to a degree where quietness with a vehicle has become a universal standard, it has become more difficult, if not impossible, for the operator as well as service personnel to discriminate against abnormal sounds, particularly in the low frequency range common to vehicle faults. In an open vehicle it likewise is difficult, if not impossible to discriminate against wind noise and other related traffic and exterior sounds.

The need for a system of this nature is as important from a safety standardpoint, as is the common seasonal State-regulated vehicle safety inspection which is generally performed by visual means and without an adequate device to detect faults that are uncommon to the frequency selectivity of the human ear.

Development and testing of this system has proven that generally all fault sounds are transmitted from their eminating positions through the structural members of the vehicle and can be detected by means of a single transducer placed at any convenient location. The luggage compartment, as an example, has been found to be a most suitable location for this purpose, since the compartment generally acts as an effective sound chamber and a most convenient location for placement of transducers when general inspection of a vehicle is intended.

Important features of this system are means for filtering out noises and sounds unrelated to fault conditions and means for tone control of the actual fault sound that prevents more specific analysis of the fault condition.

Another important feature of this system is an effective transducer that has a capability to pick up sounds that are transmitted through the air as well as vibrations that are transmitted through mechanical members of the vehicle and both of which may be singly or collectively transmitted to the vehicle operator as audible sounds or electrical impulses.

In addition, this system or systems as illustrated in the attached drawings may also be adapted to discern signals representative of special conditions of filtering, phase detection or comparison against other signals.

DESCRIPTION OF THE PREFERRED EMBODIMENT

Figure 2:
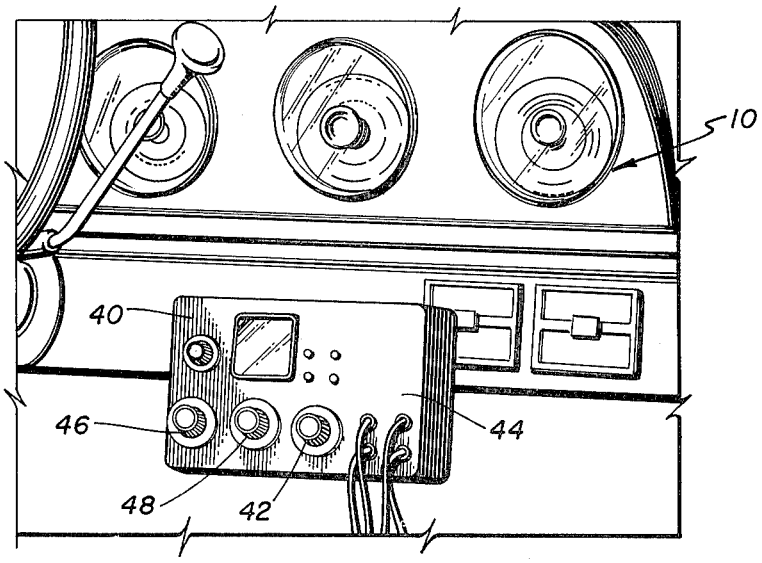
FIG. 2 is a perspective view of an under-the-dashboard installation of the master unit and indicator embodying the principles of the present invention.

FIG. 1 shows the exterior of a vehicle in which the device of the present invention is mounted. FIG. 2 shows the main portion of the device mounted under the dashboard of the vehicle.

Figure 3:
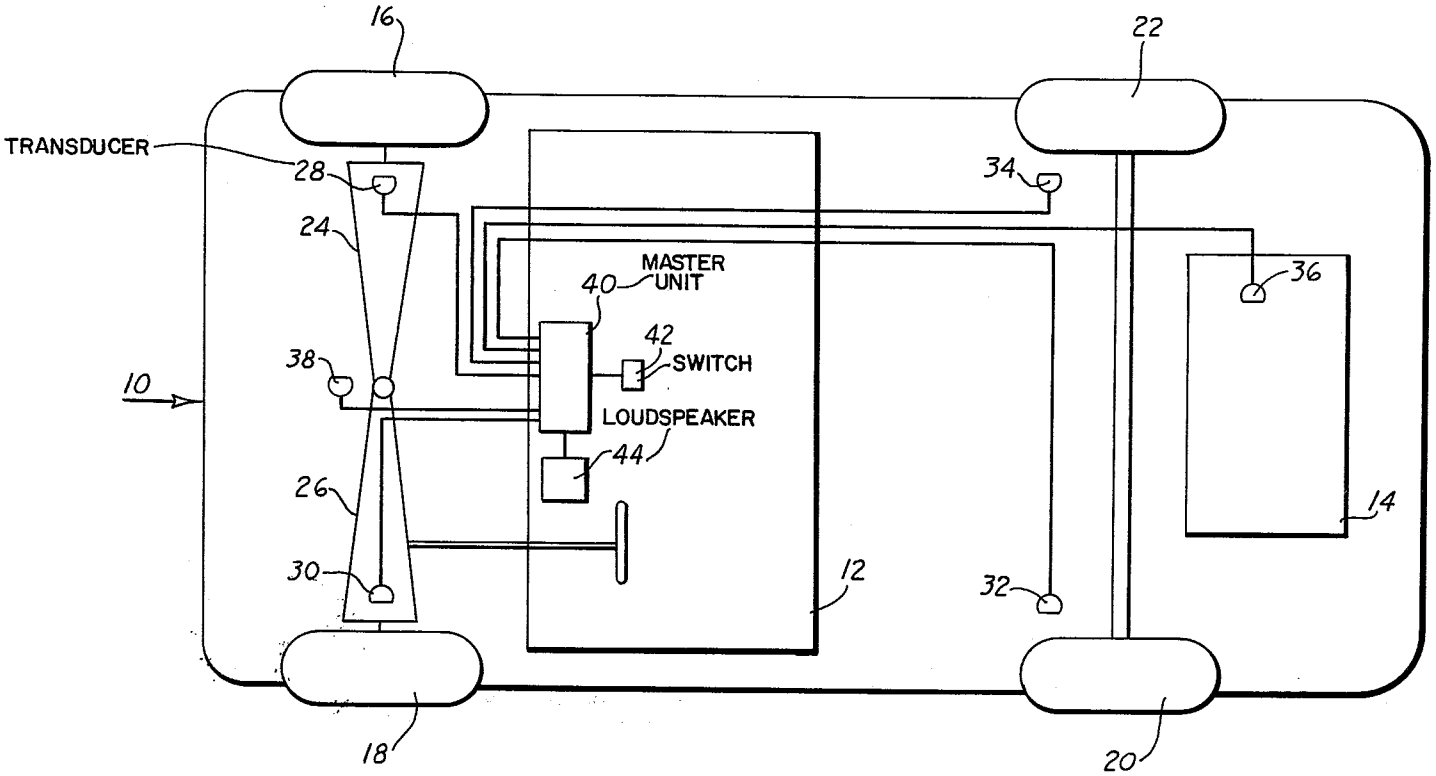
FIG.3 is a diagrammatic representation of the general layout within the vehicle of an automobile warning system embodying the principles of the present invention.

FIG. 3 shows in outline form, a motor vehicle 10 having a passenger compartment 12, a luggage compartment 14, wheels 16, 18, 20, 22 and a front wheel suspension 24 and 26. Adjacent to these positions are placed transducers 28, 30, 32, 34, 36 and 38. These individual pick-ups are connected through individual leads to a master unit 40, one position of which is switch 42. Also connected to the master unit 40 is output device 44, which may be any type of indicating or recording device, but which is preferably a loudspeaker. The details of the functions of master unit 40 will be described herein below in reference to FIG. 4. However, the general workings of the simplified embodiment of the instant invention will be described immediately below.

In the normal or standby state switch 42 may be used to connect all the transducers in parallel. The master unit 40 amplifies the vibrations picked up by these transducers and transmits these vibrations as audio sounds through the loudspeaker 44 to the vehicle operator or other listener. If an abnormal vibration is detected, it will appear as an abnormal sound to the operator. The operator may then, by proper manipulation of switch 42, isolate the source of the sound by determining the transducer in which the sound is being detected. The characteristics of the audio signals may then be used to determine the type and magnitude of the fault condition. This determination may be accomplished by mechanical or electrical signal condition means or by an operator trained to recognize and interpret the characteristic sounds of common fault conditions such as worn or loose universal joints, ball joints, axel connecting and control arms, tie rods, shock absorbers, motor mounts, wheel bearings, the thump of a tire with a broken cord and other defects.

Figure 4:
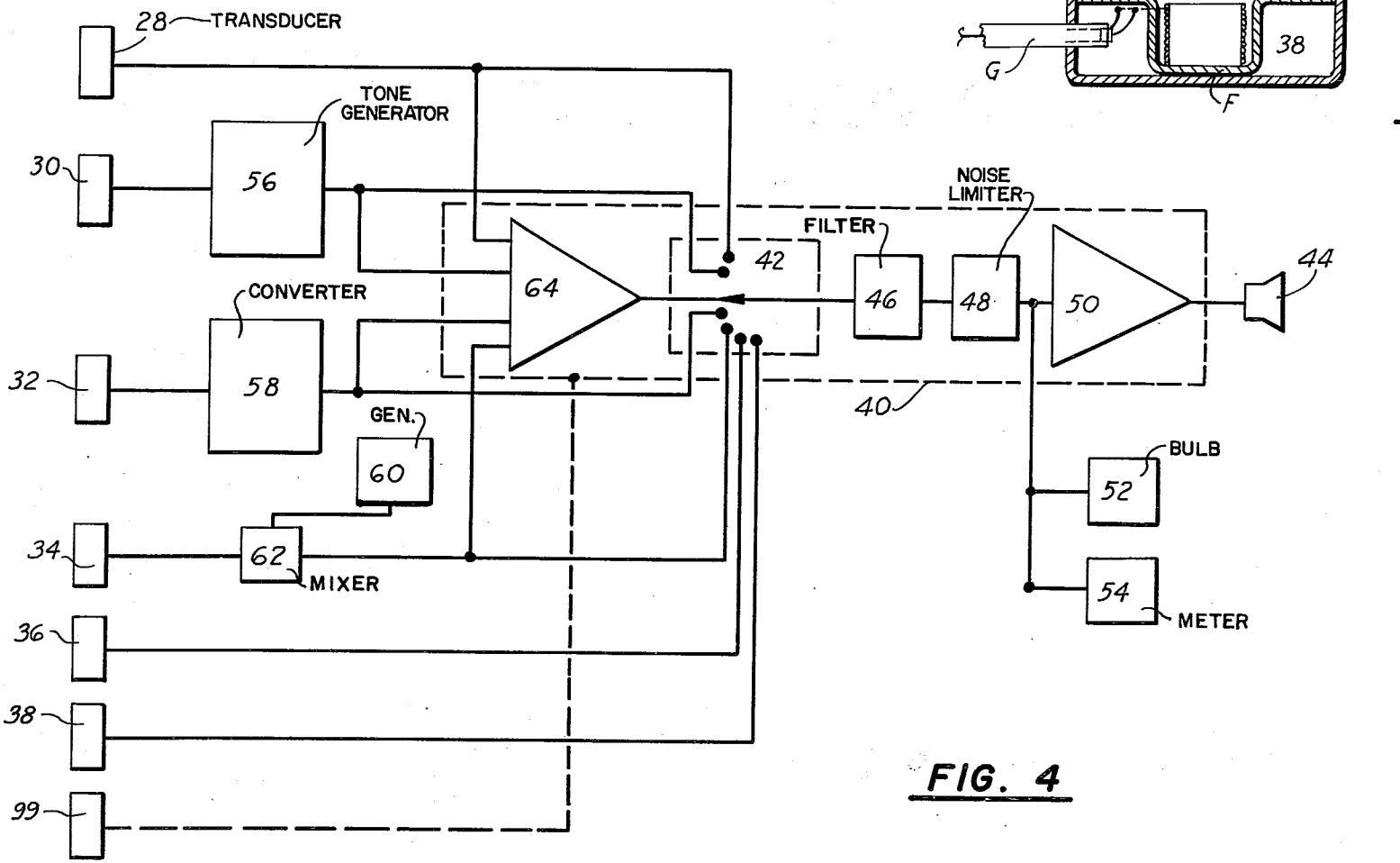
FIG. 4 is a diagrammatic representation showing the relationships among the various major components in the automobile warning system.

FIG. 4 is a representation in schematic form of a more detailed showing of the invention than is shown in FIG.

3. In general, transducers 28, 30, 32, 34, 36 and 38 are connected through their respective signal conditioning means to switch 42 within the master unit 40. The output of switch 42 is processed by a switchable filter 46, a noise limiter 48, and a power amplifier 50. The output of the amplifier 50 is fed to a loudspeaker 44. The signal being processed may alternately be brought to the operator's attention by visual means such as a light bulb 52, or a meter 54, both of which would be driven by the master unit 40.

In greater detail with respect to FIG. 4, transducer 28 is a simple audio pick-up, such as a microphone. For purpose of explanation, other common types of transducers are shown. Transducer 30 is a two-state device, such as a pressure switch used to indicate the occurrence of certain fault conditions, for example, low oil pressure. Transducer 30 is utilized to activate a tone generator 56. Transducer 32 is a strain gage. The analog voltage generated is converted to an audio frequency signal by converter 58. Transducer 34 is another microphone used to detect ultrasonic mechanical vibrations. The high frequency signals produced by transducer 34 are mixed with a signal provided by generator 60, in mixer 62. The output of mixer 62 is an audio frequency signal. Transducer 36 is a coil type pick-up.

Figure 5:
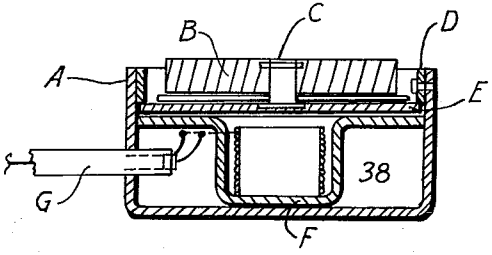
FIG. 5 is a sectional view of a transducer involved in the present invention.

Transducer 38, shown in sectional view in FIG. 5, is a specially-designed assembly of a microphone-vibration pickup that is used to detect both low and hi-frequency vibrations and convert these vibrations into sounds that are amplified through amplifier 50 and made audible through speaker 44. These sounds may first be filtered through filters 46 and 48 which are used to block out all unwanted frequencies and interference, such as ignition and motor noises. The transducer 38 consists of a container A, a magnet B, which is used as a means of attachment of the transducer to respective sections of the vehicle on assembly rivet C, a magnet-supporting ring D, a perforated baffle plate E, a microphone F and, a connecting cable G. With this particular transducer, vibrations are picked up by the magnet B and transmitted through the attaching ring D, through the baffle plate E and converted to sounds which are picked up by the microphone F and transmitted through the cable G, to the master unit 40 and the speaker 44.

Another pick-up means is a wireless microphone 99 which may be used to transmit sounds through a simple radio receiver, the output of which is fed through master unit 40.

It is, therefore, apparent that many combinations and permutations of the invention are possible for particular applications. In general, however, it is useful to provide the motor vehicle with a plurality of the same type of transducer in several locations, such as the four microphones attached to the front and near end control arms as shown in FIG. 3. In this way the invention may be used to continuously monitor many aspects of the operation of the motor vehicle, quickly isolating the area in which a fault condition occurs and at the same time providing an alarm or other information signal concerning the other functions of the vehicle through the same audio system.

Figure 6:
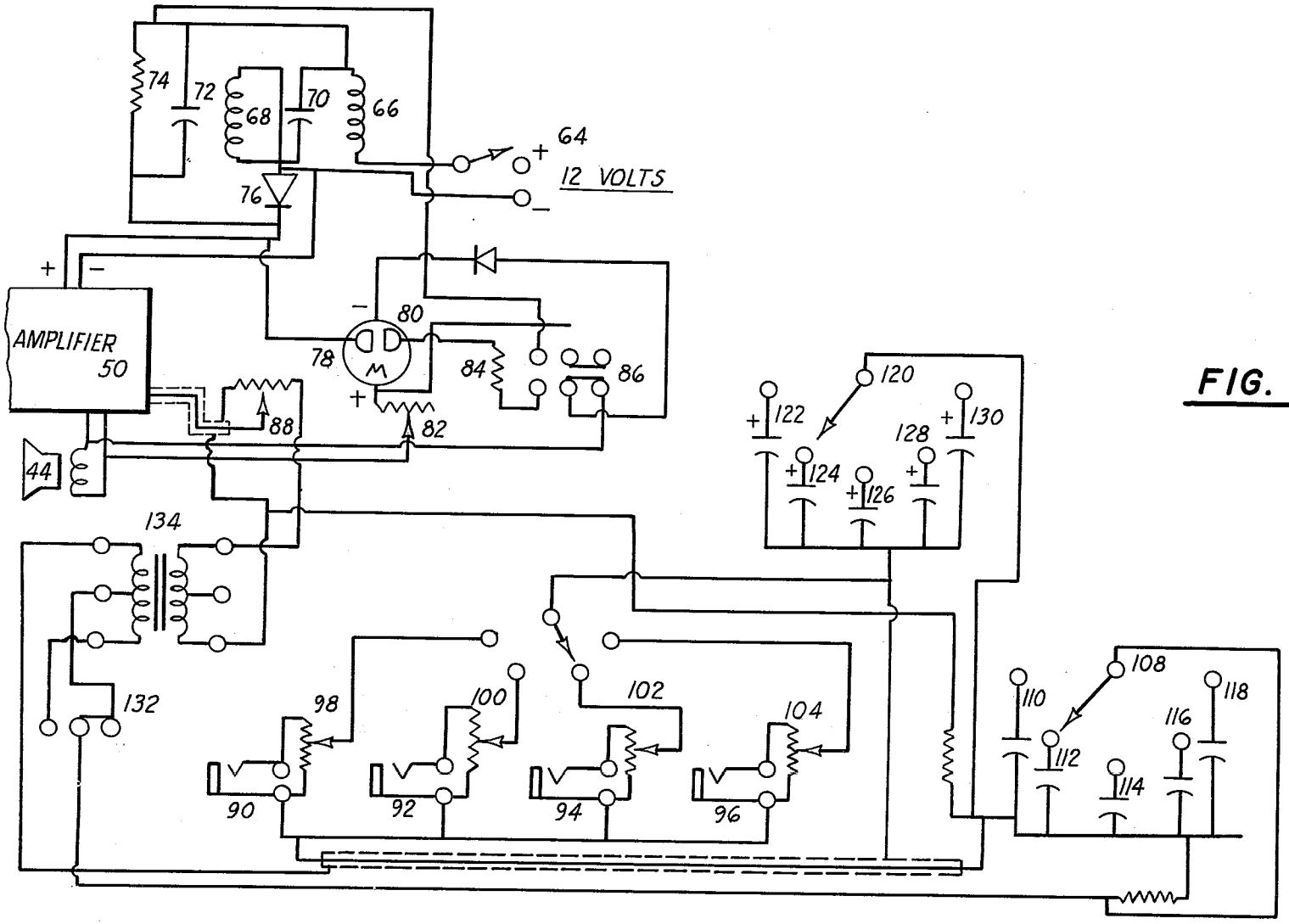
FIG. 6 is a diagrammatic representation of the electronic circuitry used in the present invention.

FIG. 6 represents a diagram of a circuit which may be used as a diagnostic aid to detect and locate fault conditions in a motor vehicle. Input 64 may be power source, such as a battery or a means of connecting the instrument to the vehicle current system, such as a plug inserted into the vehicle cigarette lighter receptacle or ignition switch. The battery positive and negative connections may pass through noise-eliminating coils 66 and 68 and capacitors 70 and 72. Voltage may be reduced by passing through a resistor 74 and a diode 76 before being applied to the amplifier 50, a meter 78, and a meter light 80. Meter scale reading may be adjusted by variable resistor 82. A resistor 84 may be used to adjust current for light 80. A slide switch 86 may be used as a means to cause the meter 78 to read out voltage input or input signal strength. A speaker 44 may be used to convert input signals into audible sounds. A variable resistor 88 may be used as a volume control of audible sounds. Input jacks 90, 92, 94, and 96 may be used as transducer cable connectors. Variable resistors 98, 100, 102, and 104 may be used to balance a plurality of transducers (not shown).

A rotary switch 106 may be used as a means to select individual input signals which may read as signals on meter 78 or heard as audible sounds from speaker 44. This switch and meter may provide a means of comparing signal strength from one transducer to the other and by selection of source producing the greatest signal may isolate the position of fault condition.

A rotary switch 108 may be used as a selector of a variation of frequencies that may be provided by capacitors 110, 112, 114, 116, and 118 which may restrict the passing of certain unwanted frequencies and allow other desirable frequencies to pass through to rotary switch 120.

A rotary switch 120 may be used to provide means to eliminate unwanted noises, such as ignition, motor, wind, outside vehicle and other interference. Elimination of these undesirable noises may be accomplished by allowing the input signal to pass through capacitors 122, 124, 126, 128, or 130.

A slide switch 132 may be used to provide a greater or lessor frequency or gain range through output transformer 134 before output signal is fed through amplifier 50.

It should be noted that many of the elements of this circuit have cooresponding elements in the standard vehicle radio and in appropriate cases, the elements could be shared.

It is recognized that the instrument as described and illustrated in the accompanying drawings as an example of one possible method of construction and that construction is not limited to this specific method, since many components may be added or deducted or changed in configuration without departing from the scope of this invention.

The invention having been thus described, what is claimed as new and desired to secure by Letters Patent is:

1. A warning system for installation in a vehicle to report the condition of various critical running gear comprising a. a plurality of transducers, each transducer being located at a different position adjacent a critical running gear in the vehicle to receive impulses from such gear and to generate a signal containing raw information, the transducers being attached to their positions by magnets, the vehicle having front wheel supporting members and the transducers being located on the members.

b. a master unit to which each transducer is connected, the unit including filtering means to remove extraneous information from the raw information in the signal, the filtering means including a variable high-pass frequency filter, the filtering means including frequency suppressing elements, the filtering means also including a variable lowpass frequency filter, and c. an indicator connected to the master unit to receive the remaining signal.

* * * * *